US005263594A

United States Patent [19]

Bianchi

[11] Patent Number: 5,263,594

[45] Date of Patent: Nov. 23, 1993

[54] CURTAIN ROD FOR SLIDABLY SUPPORTING A CURTAIN AROUND AN INTERMEDIATE CORNER, AND INTERMEDIATE JUNCTION ELEMENT THEREFOR

[75] Inventor: Alberto Bianchi, Cermenate, Italy

[73] Assignee: Stanley Works (Italia) S.r.l., Figino Serenza, Italy

[21] Appl. No.: 733,179

[22] Filed: Jul. 19, 1991

[30] Foreign Application Priority Data

Jul. 20, 1990 [IT] Italy ..... 21004 A/90

[51] Int. Cl.[5] ..... A47H 1/02

[52] U.S. Cl. ..... 211/105.2; 403/295; 403/223; 248/261; 16/96 R

[58] Field of Search ..... 211/105.2, 105.1, 105.3; 248/261, 263, 264; 403/295, 292, 223, 229; 160/330; 16/96 R, 96 D

[56] References Cited

U.S. PATENT DOCUMENTS

| | | | |
|---|---|---|---|
| 1,085,654 | 2/1914 | Williams | 16/96 R |
| 1,989,257 | 1/1935 | Allen | 211/105.1 |
| 2,201,043 | 5/1940 | Kirsch | 211/105.5 |
| 2,890,799 | 6/1959 | Rosenbaum | 211/105.2 |
| 2,989,324 | 6/1961 | O'Halloran | 403/223 X |
| 4,581,788 | 4/1986 | Baumann | 16/96 DX |
| 4,702,528 | 10/1987 | Sacks | 403/292 X |
| 5,048,997 | 9/1991 | Peterson | 403/295 |

FOREIGN PATENT DOCUMENTS

| | | | |
|---|---|---|---|
| 2448376 | 10/1974 | Fed. Rep. of Germany | 211/105.1 |
| 2531794 | 7/1975 | Fed. Rep. of Germany | 403/295 |
| 1467343 | 1/1967 | France . | |

*Primary Examiner*—David A. Scherbel
*Assistant Examiner*—Korie H. Chan
*Attorney, Agent, or Firm*—Cushman, Darby & Cushman

[57] ABSTRACT

A section bar for supporting curtains, allowing said curtains to slide, is constituted by at least two portions of section bar united to each other by a juncture element and having a hollow, contoured cross-section with a longitudinal side groove from which sliding support elements for curtain portions protrude. The juncture element has a cross-section complementary to the cross-section of the section bar. The juncture element has end portions which are suitable for being slid into the section bar and a middle portion which is provided, in regions thereof which are opposite to the sides of said longitudinal groove, with a plurality of variously shaped partial-notch-slots, such as to enable the juncture element to be bent according to any desired angles. The juncture element preferably includes, within its body, rigid elements capable of being bent together with the body.

8 Claims, 2 Drawing Sheets

12
18
25
24
23
13
16b
16a
15
III
19
31
28
27
30
29
26
β
11
21
22
20

CURTAIN ROD FOR SLIDABLY SUPPORTING A CURTAIN AROUND AN INTERMEDIATE CORNER, AND INTERMEDIATE JUNCTION ELEMENT THEREFOR

BACKGROUND OF THE INVENTION

The present invention relates to a curtain rod for slidably supporting curtains, and to a variable-position juncture element for joining sections of the curtain rod.

In the field of curtain rods for supporting curtains, allowing said curtains to slide, or more precisely allowing saddles or curtain runners and other possible curtain drive or support elements to slide, juncture elements for accomplishing the juncture between sections or portions of the curtain rod with hollow cylindrical or rectangular sleeve elements, which may be either rectilinear or bent, are known.

Such elements are usually slid onto outsides of the portions to unite them, and generally, inasmuch as their height or width is larger than that of the portions to be united, they generate a step which causes the curtain-supporting runners to catch and stop. Furthermore, the prior art bent portions (i.e., juncture elements), in case they have a fixed structure, are poorly flexible in use, in that they require a predetermined bent pattern to be mandatorily adopted, which sometimes does not correspond to the requirements posed by the particular application envisaged. On the other hand, if such juncture elements are suitable for being bent, they usually cause internal bosses or folds to arise, which increase the causes of runner stopping. This problem is even more severe for all the other functional elements which may be slidingly supported by the curtain rod.

Therefore the technical problem is evident, of being able to realize a curtain rod for slidingly supporting curtains, which is capable of solving the above-described drawbacks, making possible an easy and confortable sliding to be obtained by means of a good juncture element which makes possible variable positioning as desired, i.e., a spatial disposition specific to the inclination and bending radius of the necessary application, to be accomplished.

Of course, such a curtain rod and/or juncture element should also allow drive elements for the curtain, support elements for curtain ends, and, more generally, the cumbersome elements which sometimes are necessary in certain curtain support applications, to perfectly slide thereon.

SUMMARY OF THE INVENTION

These, and still other purposes according to the present invention are achieved by providing a curtain rod for supporting curtains and allowing the curtains to slide, which curtain rod is constituted by at least two sections or portions which are united to each other by a juncture element and having a hollow, contoured cross-section with a longitudinal side groove from which sliding support elements for curtain panels protrude, characterized in that the juncture element, which also has a hollow, contoured cross-section with a longitudinal groove, equal to said groove of the two portions of curtain rod, has complementary end portions suitable for being slid into respective ends of the two portions of curtain rod, and a middle portion which is provided, in regions thereof which are opposite to the sides of said longitudinal groove, with a plurality of variously shaped partial-notch slots, such as to enable the juncture element to be bent to any desired curvature.

Preferably, the juncture element comprises in its body, rigid elements which are capable of being bent together with the body, and which will cooperate to maintain the spatial disposition given by the user to the juncture element.

Advantageously, a variable-position juncture element for use in practicing the present invention is constituted by a body with a hollow-contoured transverse cross-section, with a side-facing longitudinal groove having an approximately C-shaped transverse cross-section, in which regions of the cross-section nearby the groove show a plurality of variously shaped notch-slots, such as to enable the same element to be given a bending according to the desired angle, with a middle portion of the C-shaped body opposite to the groove comprising inside its interior at least one rigid element suitable for being bent, and capable of keeping the juncture element maintained in the position given to it by deformation.

BRIEF DESCRIPTION OF THE DRAWINGS

The characteristics and advantages of the present invention will be clearer from the following description made by referring to the attached schematic drawings, in which.

DETAILED DESCRIPTION

Figure 1:
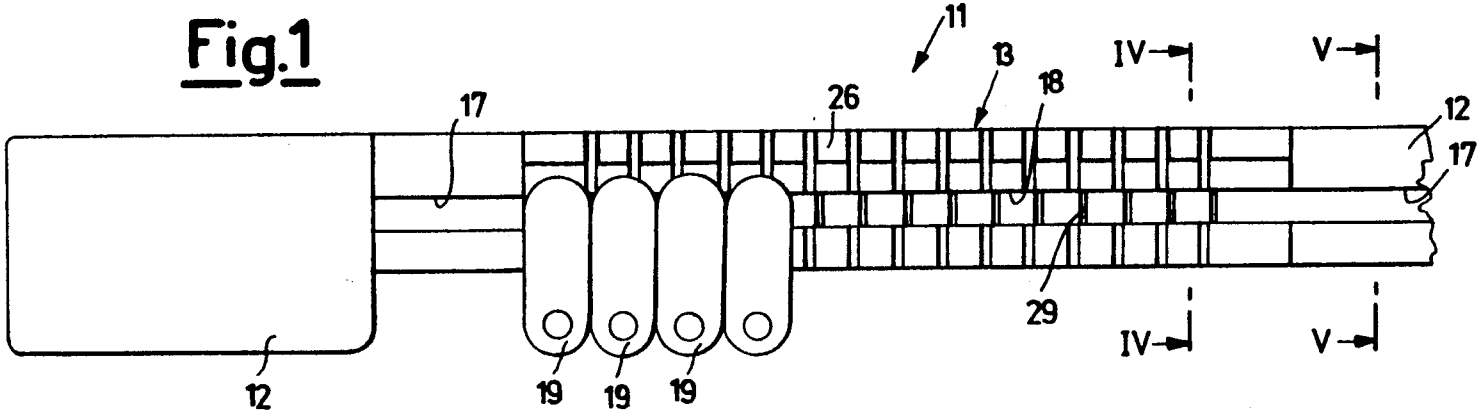
FIG. 1 is a side elevation view of a curtain rod for slidingly supporting curtains according to the present invention.
Figure 2:
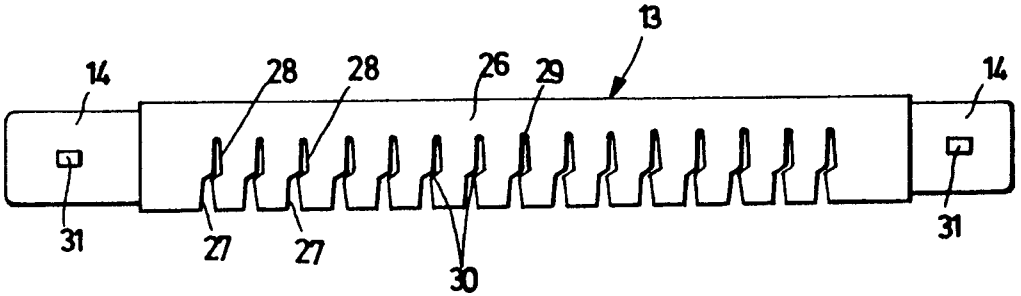
FIG. 2 is a top plan view of the juncture element of the curtain rod shown in FIG. 1.
Figure 3:
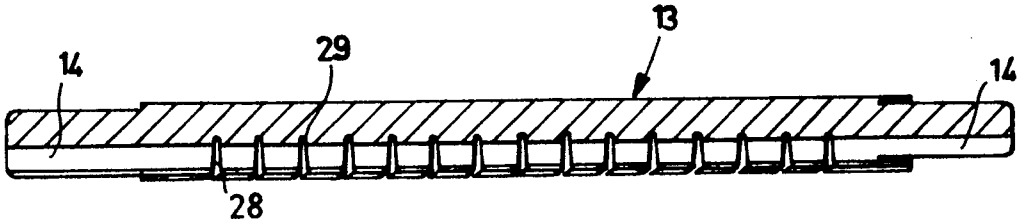
FIG. 3 is a longitudinal sectional view of the juncture element on line 3—3 of FIG. 4.
Figures 4, 5, 6:
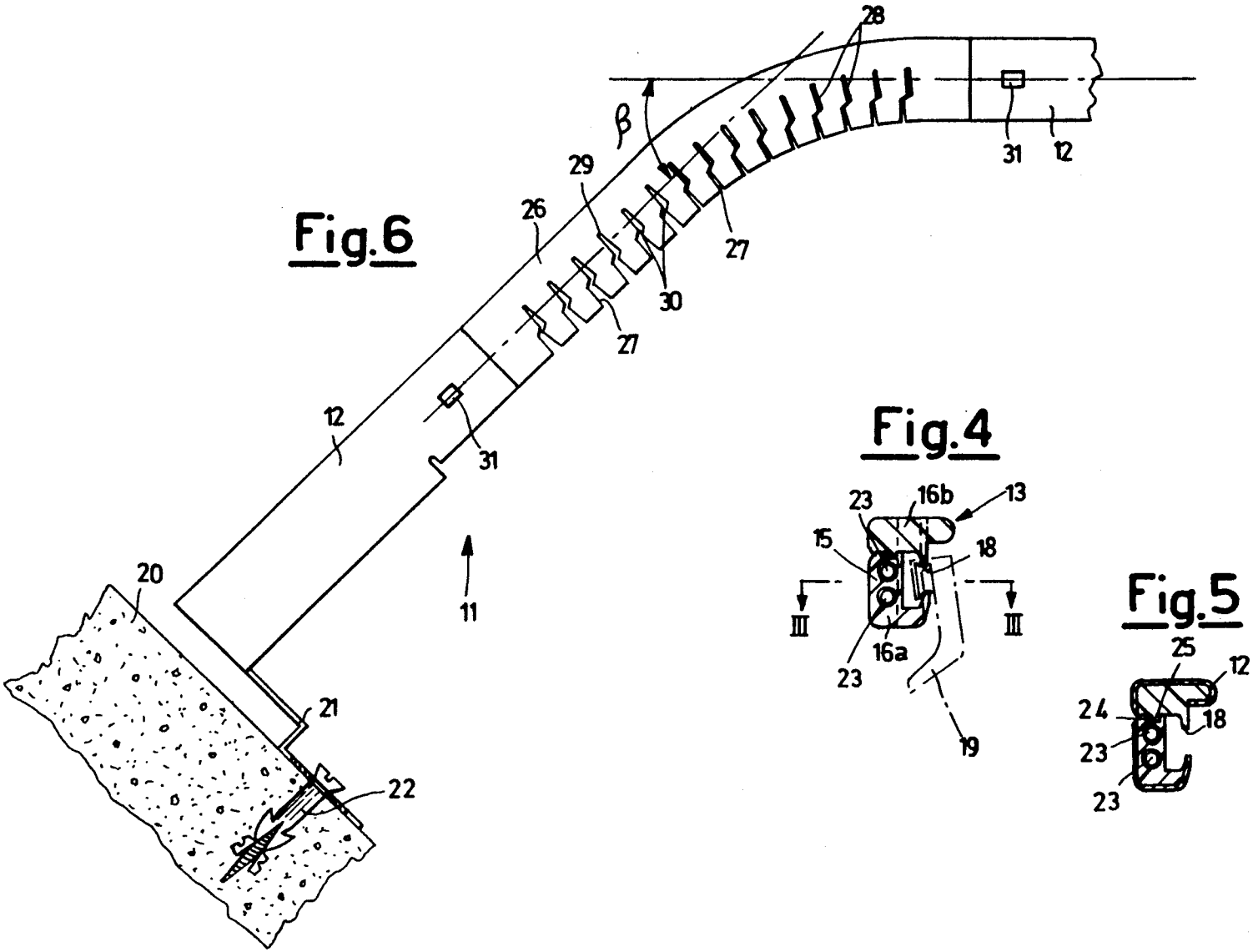
FIG. 4 is a transverse cross-sectional view of the curtain rod on line 4—4 of FIG. 1, with a curtain-supporting runner shown in chain line.
FIG. 5 is a transverse cross-sectional view of the curtain rod on line 5—5 of FIG. 1 and, FIG. 6 is a top plan view of the curtain rod of FIG. 1, installed on a wall and with the juncture element being bent into an arc according to a required angle $\beta$.

Referring to FIGS. 1 and 6, a curtain rod for slidingly supporting curtains according to the invention is shown, and generally indicated by reference numeral 11. The curtain rod 11 is shown including two portions 12 which are united to each other by an intermediate juncture element 13 by the insertion of respective opposite end portions 14 of the juncture element 13 into respective ends of respective portions 12 of the curtain rod.

For convenience in description, the side of the curtain rod 11 which faces the viewer in FIG. 1 is referred to herein as the inner side, and the opposite side, which faces towards the left in FIGS. 4 and 5, is referred to as the outer side. Likewise, the side of the intermediate juncture element 13 which faces the viewer in FIG. 1 is referred to as the front face, and the opposite side, which faces towards the left in FIGS. 4 and 5, referred to as the rear face.

The curtain rod sections 12 and the juncture element 13 each a transverse cross-section with an approximately "C" shape, comprising a middle region 15 and two side regions 16*a* and 16*b*, whose ends are opposite to each other. In this way, a continuous side-opening longitudinal groove is defined, which is composed by portions 17 on the curtain rod sections 12 and portions 18 on the juncture element 13, and inside of which groove saddles (not depicted in figures), or runners 19 or similar conventional curtain support and/or drive elements are slidingly arranged. (Panels of the curtain which is conventional, are not shown in the drawings.)

The curtain rod portions 12, if they are end portions as shown in FIG. 6, are fastened to a wall 20 by means of a bracket 21 and relevant fastening screws 22.

The juncture element 13 is constituted by a body with a hollow-contoured transverse cross-section which, in the depicted example, is composed by two parts that are welded to each other to provide a unitary body. A first portion of the element 13 comprises the middle region 15, inside of which two rigid, tubular, continuous elements 23, capable of being bent together with the body, are embedded during manufacturing so as to cooperate to preserve the configuration given to the juncture element 13. The first portion of the element 13, as shown, further comprises a first side region 16*a*. The second portion comprises the second, opposite, side region 16*b*. On both the second side region 16*b* and the middle region 15, hollows 24 and complementary protruding elements 25 are provided, which make it possible for both parts of the juncture element to be coupled and fastened to each other, e.g. by ultra-sound welding.

Between its longitudinal end portions 14, and the juncture element 13 has a longitudinal central portion 26 which is provided with a plurality of partial-notch-slots, which may be variously shaped, but are such as to allow the whole juncture element to be bent according to a desired angle $\beta$, which may be of up to or slightly more than 90°. In the depicted example, which is shown for illustrative purposes, such slots are each constituted by a first slot portion 27 which is enlarged and open outwards and provided in the upper side region 16*b*, by a second, more inner, portion 28 with a "V"-shape, provided in the upper side region 16*b* and in the lower side region 16*a*, and an end portion 29 which is provided in the whole body of the juncture element immediately opposite to the middle region 15 and running through the side regions 16*a* and 16*b*.

In the upper side region 16*b* of the longitudinal middle portion 26 between the two portions 27 and 28, in order to realize one single notch-slot, an intermediate union portion 30 is provided and arranged so as to be inclined to the first two portions, so as to connect them, or nearly close them, in that the latter are parallel but staggered to each other.

Thus, such a particular arrangement secures the continuity of the longitudinal groove 18 in the presence of any bend. Furthermore, the presence of such contoured shapes facilitates the bending, and prevents folds from being formed, in that the whole resulting structure is such that there exists a possibility of accommodating the excess material of the compressed fibres.

Furthermore, according to the present invention, for the purpose of securing a firm connection between the curtain rod sections 12 and the juncture element 13, snap-hooking means 31 are provided, constituted on respective portions by a boss and a respective slot or recess for housing it, each integrally provided with the relevant portion at the manufacturing time.

Particular forms of practical embodiment of the various components have been shown for exemplifying purposes, but such shapes can be changed as desired without however departing from the scope of the invention. For example, the curtain rod could be given an open circular shape, a square shape or a rectangular shape, a polygonal shape, and so forth.

The curtain rod according to the present invention and the juncture element thereof make it possible for a curtain to be constrained or operatively arranged in front of a window with walls, or simply lined-up to it, or arranged angularly, according to any desired angles. In this way, on the fastening portion of the curtain rod, arranged at an angle, the curtain can be advantageously gathered when the curtain is not being used, so as to occupy a space which is as small as possible, and with the maximum inlet of light to the room being simultaneously permitted. Furthermore, this kind of arrangement also enables a total covering of the opening of the window to be accomplished, with the complete elimination of entering light.

The special structure according to the present invention makes it possible for the curtain rod to be used with curtains which are either equipped with end-driven runners, or driven and moved by ropes, as well as with any types of drive means.

In the presence of drive ropes for the support elements which support the curtain portions, such ropes can be caused to run inside the continuous tubes 23. In that way, the ropes are also guided along the bent portions of their path, and the continuous tubes constitute slide guides.

According to the preferred form of practical embodiment of the invention, the juncture element is made from plastics material and the tubes contained inside it are made from metal, so as to facilitate the use and positioning of the whole structure by the user.

Furthermore, by providing a curtain rod according to the present invention, a perfect alignment is obtained between the component curtain rod sections and the juncture element, thus eliminating any possibility of hindrances to the free sliding of the elements positioned inside it, because of the continuity of the sliding groove, as well as its sealing towards the outside.

The provision of the middle portions 30 of the notch-slots also serves to secure a continuous and safe retention of the sliding elements, both in bent portions of the juncture element, and when the later is in a straight configuration, defining a hypothetical retention line corresponding to the sliding line along which the sliding elements slide, due to the presence of the intermediate union portions 30.

The juncture element 13 may be made so as to have a different colour than the rod portions 12, so as to modify the total esthetical appearance of the curtain rod, even bearing drawings or decorative patterns.

I claim:

1. A curtain rod for hangingly slidably supporting a curtain, on an inner side of said curtain rod, from a plurality of curtain support elements having generally vertical shanks and having curtain connectors and upset slider heads at opposite ends of respective ones of said shanks, said curtain rod comprising:

two curtain rod sections having respective one ends, said sections being disposed in longitudinal alignment along a substantially horizontally extending curtain support path; and an intermediate juncture element having two longitudinally opposite ends, each telescopically received within a respective one end of a respective said curtain rod section, and disposed in longitudinal alignment with said two curtain rod sections along said curtain support path said juncture element having a front face and a rear face which are opposed to one another on transversally opposite sides of said path;

said curtain rod sections and said juncture element each being generally C-shaped in transverse cross-sectional shape and thereby providing means defining a respective longitudinally continuous slot which opens in a direction which is substantially horizontal and transverse to said path, said slots of said curtain rod sections and said juncture element together form a groove for slidingly receiving said upset slider heads of said curtain support elements; and means defining a longitudinally extending series of longitudinally spaced, vertically oriented, horizontally opening notches in said front face of said juncture element; said notches being sufficiently deep transversally of said path in a front to rear direction of said juncture element, and sufficiently wide longitudinally of said path, as to permit said juncture element to be bent by a desired amount within a predetermined range, into an arc having a selected curvature, whereupon said curtain rod sections extend at less than a 180° angle to one another on said inner side of said curtain rod;

cooperative fastening means provided on respective end portions of said curtain rod sections and said juncture element, respective ones of which cooperative fastening means snap together for maintaining connections between respective ends of said curtain rod sections and juncture element;

said juncture element, as viewed in transverse cross section, having an upper limb and a lower limb above and below where the respective said slot opens out of said juncture element, and a central, outer base joining said upper and lower limb, behind the respective said slot; said upper and lower limbs being formed on two different members; and means interconnecting said two different members to one another to unite said juncture element;

said groove opening through said inner side of said curtain rod;

said notches cutting into said upper and lower limbs of said juncture element above and below where the respective said slot opens through said juncture element; and said notches also cutting into said central, outer base of said juncture element between said upper and lower limbs of said juncture element, behind the respective said slot, as viewed looking outwards transversally of said path from the inner side of said curtain rod.

2. The curtain rod of claim 1, further comprising:

said juncture element further including a plurality of longitudinally extending, shape-retaining tubular bendable elements embedded in said outer base thereof, for maintaining said selected curvature of said juncture element when said juncture element has been bent into said arc.

3. The curtain rod of claim 1, wherein:

each notch, as viewed in plan, is generally V-shaped, with three regions, including a narrowest outer region disposed furthest from said inner side of said curtain rod, a broadest inner region, and an intermediate region, which jogs longitudinally of the juncture element to connect a respective said outer region with a respective said inner region.

4. The curtain rod of claim 2, wherein:

said tubular bendable elements are arranged for accessibility from externally of said curtain rod so as to permit curtain-operating cords to be slidingly strung therein.

5. For connection with a curtain rod for hangingly slidably supporting a curtain, on an inner side of said curtain rod, from plurality of curtain support elements having generally vertical shank and having curtain connectors and upset slider heads at opposite ends of respective ones of said shanks, between two curtain rod sections having respective one ends, said sections being disposed in longitudinal alignment along a substantially horizontally extending curtain support path, and which curtain rod sections each being generally C-shaped in transverse cross-sectional shape and thereby providing means defining a respective longitudinally continuous slot which opens in a direction which is substantially horizontal and transverse to said path, said slots form respective portions of a groove for slidingly receiving said upset slider heads of said curtain support elements, an intermediate juncture element, comprising:

a longitudinally elongated bendable body having two longitudinally opposite ends, each arranged to be telescopically received within a respective one end of a respective said curtain rod section, so as to dispose said juncture element in longitudinal alignment with said two curtain rod sections along said curtain support path said juncture element having a front face and a rear face which are opposed to one another on transversally opposite sides of said path;

said juncture element being generally C-shaped in transverse cross-sectional shape and thereby providing means defining a respective longitudinally continuous slot which opens in a direction which is substantially horizontal and transverse to said path, said slot of said juncture element being arranged to form a respective portion of said groove for slidingly receiving said upset slider heads of said curtain support elements;

means defining a longitudinally extending series of longitudinally spaced, vertically oriented, horizontally opening notches in said front face of said juncture element; said notches being sufficiently deep transversally of said path in a front to rear direction of said juncture element, and sufficiently wide longitudinally of said path, as to permit said juncture element to be bent by a desired amount within a predetermined range, into an arc having a selected curvature, whereupon said curtain rod sections extend at less than a 180° angle to one another on said inner side of said curtain rod;

fastening means provided on respective end portions of said juncture element for cooperating with fastening means provided on respective end portions of curtain rod sections for snapping together for maintaining connections between respective ends of said curtain rod sections of said juncture element; and said juncture element, as viewed in transverse cross section, having an upper limb and a lower limb above and below where the respective said slot opens out of said juncture element, and a central, outer base joining said upper and lower limb, behind the respective said slot; said upper and lower limbs being formed on two different members; and means interconnecting said two different members to one another to unite said juncture element;

said groove opening through said inner side of said juncture element;

said notches cutting into said upper and lower limbs of said juncture element above and below where the respective said slot opens through said juncture element; and said notches also cutting into said central, outer base of said juncture element between said upper and lower limbs of said juncture element, behind the respective said slot, as viewed looking outwards transversally of said path from the inner side of said curtain rod.

6. The intermediate juncture element of claim 5, further comprising:

a plurality of longitudinally extending, shape-retaining tubular bendable elements embedded in said outer base thereof, for maintaining said selected curvature of said juncture element when said juncture element has been bent into said arc.

7. The juncture element of claim 5, wherein:

each notch, as viewed in plan, is generally V-shaped, with three regions, including a narrowest outer region disposed furthest from said inner side of said curtain rod, a broadest inner region, and an intermediate region, which jogs longitudinally of the juncture element to connect a respective said outer region with a respective said inner region.

8. The juncture element of claim 6, wherein:

said tubular bendable elements are arranged for accessibility from externally of said curtain rod so as to permit curtain-operating cords to be slidingly strung therein.

* * * * *